United States Patent [19]

Barriquand

[11] 4,291,555

[45] Sep. 29, 1981

[54] MACHINES FOR THE WET TREATMENT OF FABRICS IN ROPE FORM

[75] Inventor: Bernard Barriquand, Roanne, France

[73] Assignee: Barriquand, Roanne, France

[21] Appl. No.: 88,067

[22] Filed: Oct. 24, 1979

[30] Foreign Application Priority Data

Oct. 27, 1978 [FR] France ..... 78 30557

[51] Int. Cl.[3] ..... D06B 3/20; D06B 3/24; D06B 23/08

[52] U.S. Cl. ..... 68/13 R; 26/1; 28/289; 57/1 UN; 68/18 F; 68/177; 68/181 R; 68/184; 68/210

[58] Field of Search ..... 68/177, 178, 181 R, 68/210, 18 F, 152, 184, 13 R; 57/1 UN; 28/289; 26/1

[56] References Cited

U.S. PATENT DOCUMENTS

| | | | |
|---|---|---|---|
| 2,604,687 | 7/1952 | Broden | 28/289 X |
| 2,722,729 | 11/1955 | Wilhelm | 28/289 X |
| 3,269,152 | 8/1966 | Bell et al. | 68/177 X |
| 4,020,658 | 5/1977 | Thies, Jr. | 68/177 X |

FOREIGN PATENT DOCUMENTS

| | | | |
|---|---|---|---|
| 2546897 | 4/1977 | Fed. Rep. of Germany | 68/177 |
| 2620387 | 11/1977 | Fed. Rep. of Germany | 68/177 |
| 1379140 | 10/1964 | France | 68/177 |
| 1543776 | 9/1968 | France . | |
| 2015808 | 4/1970 | France . | |

*Primary Examiner*—Philip R. Coe
*Attorney, Agent, or Firm*—Browdy and Neimark

[57] ABSTRACT

A wet treatment machine, notably for dyeing or bleaching of fabrics in rope form, is equipped with a dyeing system and includes means for circulating, storage and folding, and fabric unloading means. It comprises, in combination: at least one dyeing system arranged in the upward path of the fabric, slightly beyond the exit of the latter from at least one storage compartment; mechanical means for returning the fabric into the one or more storage compartments, after passage of the fabric into the one or more dyeing systems arranged in the upward path of the fabric, which means are mounted at the exit of this or these dyeing systems and are, if necessary, associated with means for folding the fabric; at least one receiving and guiding device for the fabric to the one or more storage compartments, mounted in the return path of the fabric to said one or more storage compartments, beyond the mechanical fabric return means; and at least one fabric storage compartment provided with a conveyor belt for moving the fabric. The rotation of said compartment around its vertical axis can also constitute the means for moving the fabric. The aforesaid means are associated with a pump for circulating the dye bath or the like in the machine, with a heat exchanger for regulating the temperature of said bath, and with a strainer or similar filter for purifying said bath before its recycling in the machine.

39 Claims, 11 Drawing Figures

MACHINES FOR THE WET TREATMENT OF FABRICS IN ROPE FORM

BACKGROUND OF THE INVENTION

1. Field of Invention

The present invention relates to improvements in or to aqueous or wet treatment machines, such as for dyeing or bleaching, for example, of fabric in rope form, and it relates more particularly to improvements in or to wet treatment transporting, folding, storage and unloading systems for fabric in rope form in such machines.

By "fabrics in rope form" is meant, both woven fabrics and knitted fabrics, the latter being either rectilinear, or open or tubular, treated in rope form.

2. Description of the Prior Art

Machines for dyeing cloth in the rope form known in the prior art, whether they relate to dyeing becks with a very long bath ratio, jet machines or overflow box machines which use a long bath ratio, or recent machines with a short bath ratio, are equipped with means designed to ensure the circulation of the ropes of fabric in the machine and their folding. Thus becks which have a bath ratio of the order of 1:20 to 1:30, are generally equipped, for the folding of the fabric, with an oval or triangular roll which deposits the rope in folds on an inclined plane in a full bath. However, in this type of dyeing machine, the circulation of the ropes, each being of rather short length (200 m at the maximum), and their movement within the storage compartment, are effected through the dye bath, which disturbs the folding and which causes the formation of loops and of knots in the fabric, which interferes with the circulation of the latter and have an unfavorable influence on the quality of the dyeing.

In conventional jet or overflow box dyeing machines, which use a bath ratio of the order of 1:8 to 1:10, the movement of the ropes is also effected through the dye bath, the folding being carried out at the exit from the dyeing system by mechanical means such as crank, cone, perforated or unperforated, an inclined plane or by using the inner space of the machine itself. In these machines, the intervention of the dye bath to ensure the movement of the fabric has also the effect of disturbing the folding and of being the cause of the formation of loops and of knots which interfere with the circulation of the ropes and alter the quality of the dyeing.

Machines with a very short bath ratio (1:1.5 to 1:2) of the type which are the subject of U.S. patent application Ser. No. 917,408, filed on June 21, 1978, which has issued as U.S. Pat. No. 4,207,759, and French Application No. 77 38577 of Dec. 21, 1977, in the name of Applicant, enable a fabric storage essentially more satisfactory than the other known dyeing machines, in that the textile material is stored therein outside of the bath and is not, for this reason subject to any disturbance due to the bath, since it is no longer the latter which causes the fabric to advance, said fabric being moved only by mechanical means. However, in the case of the treatment of light fabrics and/or the treatment in the machine of several ropes at the same time, by a same dyeing system, with storage of the fabric in the same storage compartment, loops and knots can again nonetheless be formed in the fabric, which interfere with the circulation of the latter and alter the quality of dyeing, in spite of the use of mechanical means, which are generally constituted by the rotation of the storage compartment, or by an inclined plane on which the stock of fabric folds, which is delivered therefrom by pivoting of the inclined plane.

In addition, even in machines in which the movement of the fabric is not caused by the dye bath, as is the case in the known machines mentioned above with a very short bath radio, the dye bath will nonetheless interfere with the folding and storage of the fabric, to impede these: in fact, the dyeing system is placed at the descent of the fabric, just before the return of the latter into the storage compartment, so that the bath sprayed outside of the dyeing system situated in the descent path of the fabric, disturbs, even in such machines, the operations of folding, notably in the case where two ropes are circulating in the same system, in which the dye bath thrown out of the dyeing system situated in the descent path of the fabric can cause the separation of the two ropes, during the operations of folding and of storage, such a separation being capable of resulting, on the reascent, in the formation of loops or of knots.

To minimize the disturbances resulting therefrom on folding, there is a tendency to reduce the flow rate of the bath in the dyeing system for optimizing the operations of folding and of storage, but to the detriment of the dyeing operations.

Besides, in wet treatment machines, notably dyeing machines, known in the prior art, the unloading of the stock of treated fabric is effected by means of a hank-carrier or ring and an unloading roll. However, the existing solution is only satisfactory as long as the unloading devices for the treated fabric only unload a single rope since beyond one rope, the ropes of fabric to be unloaded amalgamate forming twists which considerably disturb unloading and can even cause its stoppage.

Accordingly, it is an object of the invention to provide a machine for the wet treatment, notably for dyeing, for bleaching or the like, of fabric in rope form which responds to the necessities of practice better than previously known machines for the same purposes, notably in that wet treatment, circulation, folding, storage and unloading systems are provided which eliminate the drawbacks of the corresponding systems known in the prior art.

GENERAL DESCRIPTION OF THE INVENTION

According to the present invention there is provided a machine for the wet treatment, and notably for dyeing or bleaching of fabric in rope form, equipped with a dyeing system and including means of circulating, storage and, if necessary, folding and unloading of the fabric, characterized in that it comprises in combination: at least one dyeing system, which is arranged in the ascent path of the fabric, slightly after the exit of the latter from the storage compartment; mechanical means for the return of the fabric into the storage compartment, after passage of the fabric into the dyeing system arranged in the upward path of the fabric, which means are mounted at the exit of the latter dyeing system; a device for receiving and guiding the fabric to the storage compartment, mounted in the return path of the fabric to said storage compartment, beyond the mechanical return means of the fabric; at least one storage compartment provided with mechanical means for the movement of the fabric, known in themselves, such as notably, a conveyor belt, the rotation of said compartment around its vertical axle, being capable, if necessary, also of constituting these mechanical means, the aforesaid means being associated with means for circulating the dye bath or the like in the machine, such as a pump, with adjustment means for the temperature of the bath, such as a heat exchanger, and with purification means for said bath before its recycling into the machine, such as a strainer or similar filter.

The machine according to the present invention is as well suited to treatment at atmospheric pressure as for treatments at high temperature.

In an advantageous embodiment of the machine according to the present invention, the device for receiving and guiding the fabric to the storage compartment, is constituted by a J-box.

In yet another embodiment of the machine according to the present invention, the latter includes a second dyeing system mounted in the return path of the fabric to the storage compartment, between said mechanical fabric return means and the device for receiving and guiding the fabric to the storage compartment.

In accordance with the invention, the means for folding the fabric are associated with the abovesaid mechanical fabric return means.

Also in accordance with the invention, in the case where the machine according to the present invention, comprises a first dyeing system arranged in the upward path of the fabric and the second dyeing system arranged on the descent path of the fabric, it can also be provided with folding means, which in this case, are inserted between the second dyeing system mounted in the descent path of the fabric, and the device for receiving and guiding the fabric to the storage compartment.

According to another feature of the machine according to the present invention, the folding means for the fabric form an integral part of the means for returning the fabric into the storage compartment.

According to an advantageous feature of this embodiment, the integrated fabric return and folding means are constituted by a drive roll of non-cylindrical cross-section, and in particular of oval or polygonal cross-section, or by a flat disc, or even again they are constituted by a cylindrical roll with an axle inclined to the horizontal whose flange opposite that associated with the end of the roll which rests on the horizontal, can, if necessary, be dissociated from the corresponding end of the roll and be arranged on the horizontal axle on which the roll is inclined.

According to another embodiment of the machine according to the present invention, the means for folding the fabric are distinct from the means for the return of the fabric to the storage compartment.

In this case, in accordance with an advantageous feature of this embodiment, the means for the return of the fabric to the storage compartment are constituted by a cylindrical fabric drawing drive roll, with which are associated, if necessary, means for folding the fabric, which are advantageously constituted, in accordance with the invention, by a ring or by a double funnel driven with a circular motion or with a to-and-fro motion, advantageously linear. These folding means are advantageously mounted following the drawing roll. They can however also be mounted before the drawing roll, that is to say between the exit from the dyeing system arranged in the reascent of the fabric and the drawing roll.

In accordance with the invention, in the case where the machine according to the present invention is equipped with two dyeing systems mounted respectively in the upward or ascent path and in the descent path of the fabric, on each side of the mechanical means for returning the fabric to the storage compartment, such as a cylindrical roll for example, it can also be equipped with aforementioned folding means, such as a ring or a double funnel, for example, these folding means being then advantageously provided between the exit from the second dyeing system and the entrance of the device for receiving and guiding the fabric to the storage compartment.

According to an advantageous embodiment of the J-box for receiving and guiding the fabric to the storage compartment, the latter is equipped with a safety device which detects too high storage of the fabric in the J-box and causes the arrest of the fabric return means and, if necessary, the reversal of their direction of operation until the removal of the excess fabric from said box.

According to yet another advantageous embodiment of the machine according to the present invention, the latter is provided with a safety device, associated with the storage compartment, which includes means for detecting any anomaly in the advance of the stock of fabric in said compartment and means for the adjustment of the speed of movement of this stock of fabric in the one or more storage compartments.

In accordance with an advantageous feature, such a safety device is constituted by a pivoting wall associated with a limit switch, itself, if necessary, associated with a speed variator which regulates the speed of operation of the mechanical fabric transport means associated with the storage compartment, which pivoting wall detects the passage of the stock of folded fabric, ready for the ascent and whose pivoting causes the arrest and/or the regulation of the operating speed of said fabric transport means.

According to yet another embodiment of the machine according to the invention, the circulation of the fabric and the flow of the bath, of dye, for example, in the dyeing system or the like, take place in counter-current to one another.

According to the invention, the means for unloading of the stock of treated fabric, from the machine, comprise as many rings as there are ropes to be unloaded and at least one unloading drive roll mounted downstream from the rings, and are characterized in that they are besides provided with at least one member adapted to be rotated or pivoted in the presence of a twist to undo the latter and at least one receiving vat for the one or more ropes of fabric to be unloaded.

According to an advantageous feature of this embodiment, the member adapted to be rotated or pivoted, is constituted by a funnel fast to the machine, to which is or are made fast the ring or rings designed for the passage of each rope of fabric, which funnel is rotated or pivoted by the detection of the presence of twists and stops in the absence of the passage of twists.

According to another advantageous feature of this embodiment, the member adapted to be rotated or pivoted is constituted by two rods fastened to one another on the one hand and to the one or more rings on the other hand.

According to yet another advantageous feature of this embodiment, the member adapted to be rotated or pivoted is constituted by a rotary or pivoting plate on which is mounted at least one vat for receiving the one or more ropes of fabric unloaded, which plate bears an axial rod which supports at its upper end, respectively the ring or rings and the unloading drive roll or rolls, the rotation of the whole being determined by the detection of the presence of twists.

According to the invention, the receiving vat for the unloaded fabric comprises, in the case of the application of the unloading device according to the invention, to the unloading of a plurality of ropes, as many compartments as there are ropes to be unloaded, or it is replaced by a plurality of contiguous independent carriages.

It will be easily understood that the receiving vat for the fabric, or storage compartment, can be multiple and notably includes several concentric or superposed compartments including either a single drawing roll cooperating with the multiple compartments, or as many drawing rolls as compartments.

Besides the foregoing features, the invention comprises still other features, which will emerge from the description which follows.

The invention is directed more particularly to aqueous treatment machines for fabric in rope form, in accordance with the preceding arrangements, as well as the means adapted for their construction and the industrial installations in which they are included.

BRIEF DESCRIPTION OF THE DRAWINGS

The invention will be better understood by means of the additional description which follows, with reference to the accompanying drawings in which.

It must be understood, however, that the drawings and the corresponding parts of the description, are given purely by way of illustration of the invention and are not to be regarded as in any way limiting.

DESCRIPTION OF PREFERRED EMBODIMENTS

Figure 1:
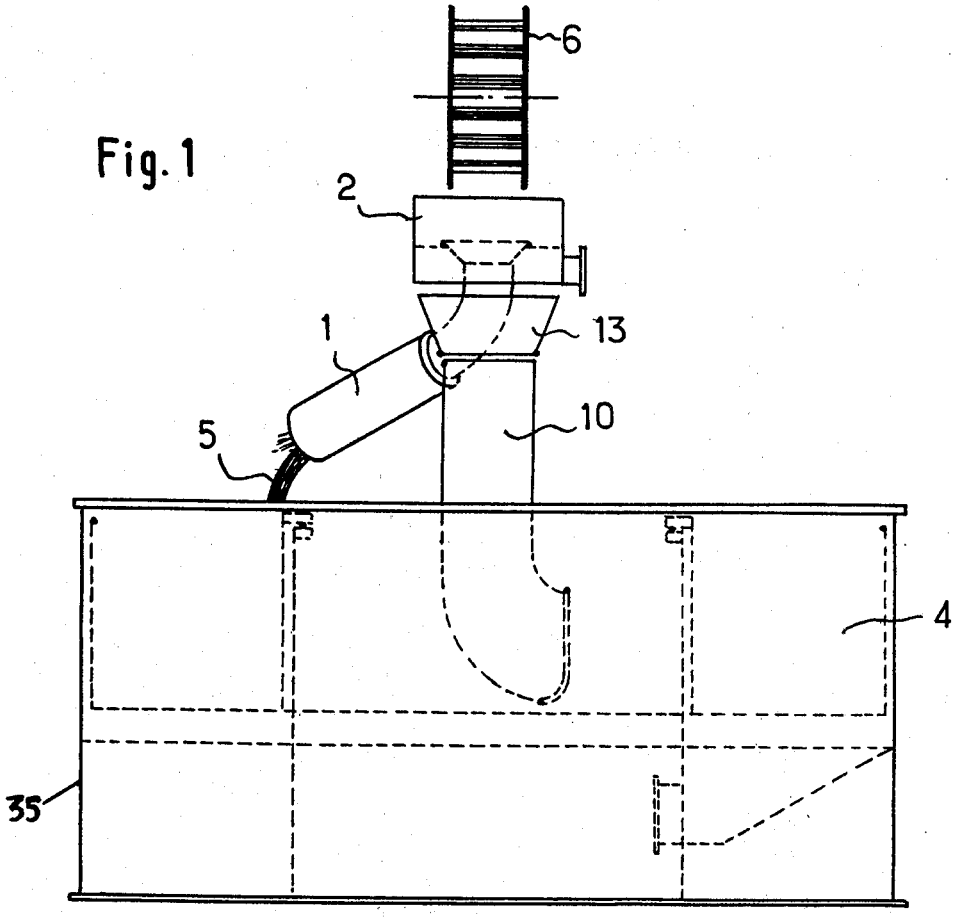
FIGS. 1, 2 and 3 represent, respectively, frontal, side and overhead diagrammatic views of one embodiment of a wet treatment machine for fabric in rope form, according to the present invention, circulating, temperature-regulating and purifying devices not being shown for the sake of clarity.
Figure 3:
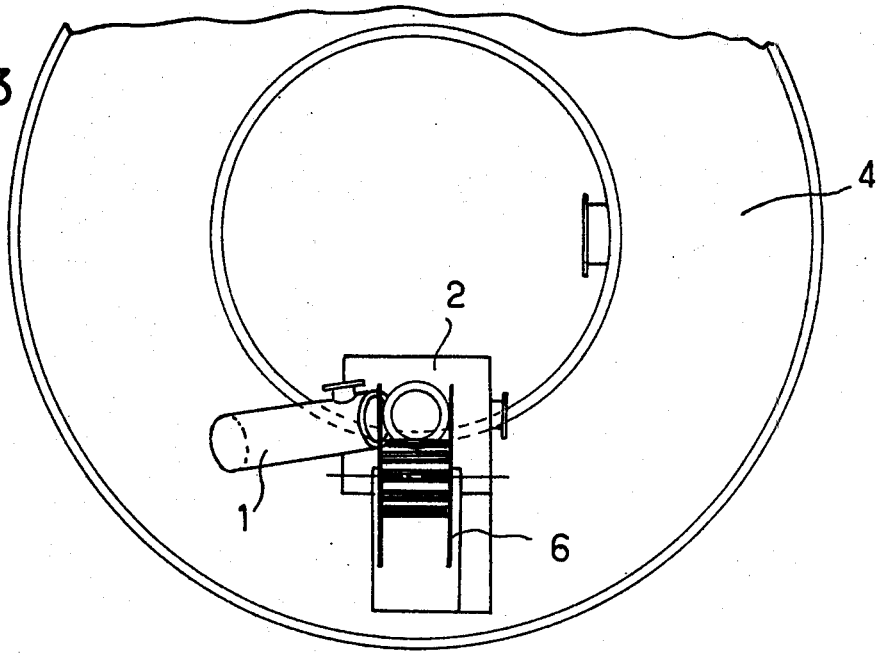

Although there has been shown very diagrammatically in the drawings, and notably in FIGS. 1 to 4, 7 and 8, a machine for the wet treatment, and more particularly for dyeing cloth in rope form, with a nozzle or an injector 1, with an overflow box 2, a guiding and impregnating tube 3, and including at least one storage compartment 4 constructed in the shape of a crown, rotatory around its vertical axis and perforated at least in its lower parts, whose characteristics are those of the machine in accordance with the U.S. patent application Ser. No. 917,408, filed on June 21, 1978, already mentioned, with a very short bath ratio, it will however be easily understood that the systems of wet treatment, of circulation, of folding, of storage and of unloading which form the subject of the present invention, are suitable for any wet treatment machine for fabric in rope form, that is to say both for the abovesaid machines with very short bath ratio, of which the novel systems according to the invention improve even further the operation and performance, and for machines with a long or very long bath ratio. It is to be noted that the one or more storage compartments is or are mounted inside a fixed cylinder 35.

In accordance with the present invention, the dyeing system which can include, by way of non-limiting example, a duct or nozzle or a ramp of injectors 1, a guiding and soaking tube 3, an overflow box 2, is mounted in the upward path of the rope(s) 5, close to the exit from the storage compartment, denoted generally by the reference numeral 4. Such an arrangement has great advantages with respect to the machines of the prior art wherein the dyeing system is in the downward path of the rope(s) that is to say close to the storage compartment, and wherein the bath thrown out of the dyeing system, interferes with the folding of the rope(s) and renders the folding and storage erratic, notably in the case where two ropes are circulating in the same dyeing system to end up in the same storage compartment. On the other hand, in the machine according to the invention, in which the dyeing system is located in the upward path of the rope(s) that is to say before the means for returning the fabric to the storage compartment, the dye bath emerging from the dyeing system flows or is thrown onto the fabric 5 at its exit from the storage compartment 4, so that when it enters the folding and storage zone, there is no longer any possibility of the bath interfering with the folding of the fabric in rope form.

It is to be noted that the circulation of the fabric 5 in the dyeing system takes place in counter-current to the circulation of the dye bath, in the example concerned. It is however possible to orient the duct 1 so as to cause the circulation of the fabric and of the bath in the same direction, that is to say to cause the bath to ascend at the same time as the fabric in the machine.

At its exit from the dyeing system arranged in the ascent path of the rope, the advance of the fabric 5 is ensured by a drive drawing roll. According to one of the embodiments of the invention, the drawing drive roll plays the role of a folding device at the same time. It is then necessary to give this roll a shape other than cylindrical: cf for example FIGS. 2, 4, 5 and 7 where the drawing drive roll 6 has an oval cross-section it being understood that a roll having a polygonal, for example triangular section would enable comparable folding to be effected. The non-circular cross-section of the roll 6 causes the formation of regular folds. These folds can be obtained, in another embodiment of the invention by associating a cylindrical drawing drive roll 7, which plays only the role of fabric moving roll at its exit from the dyeing system, with a fold forming device which may be constituted by a ring (not shown) or by a double funnel 8 (cf FIG. 6) into which the fabric downstream of the drawing roll passes. According to the invention, to obtain the formation of regular folds, it is advantageous for the device such as a ring or double funnel, to be driven in a circular motion or a to-and-fro motion, the latter preferably linear. There is obtained, with this cylindrical drawing roll and with a fold-forming system such as a ring or double funnel 8, a still more regular formation of folds, by arranging the ring or the double funnel 8 before the drawing roll 7, between the dyeing system arranged in the upward path of the rope and the latter, since such an arrangement confers on the fabric on the drawing roll 7 a double movement of advance and to-and-fro.

Figure 5:
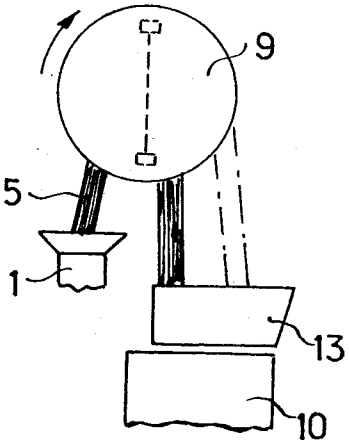
Figure 2:
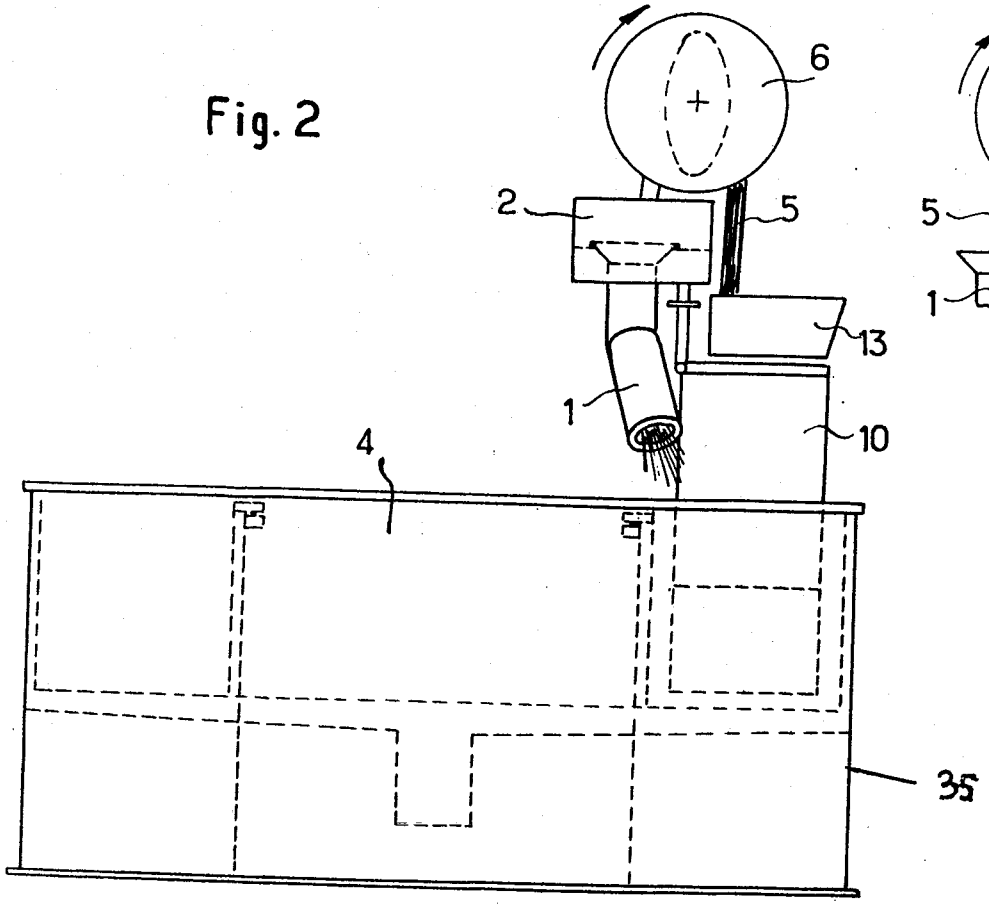

According to the invention the formation of folds can be obtained by other means than those which have just been described, and notably by using a flat disc 9 such as that shown in FIG. 5, or by using a cylindrical roll inclined to the horizontal. In the latter case, grooves must be formed on the roll, in the vicinity of its ends, to ensure the holding in position of the fabric in rope form on the roll. It is not necessary to form grooves in the vicinity of the ends of the roll when a cylindrical roll inclined to the horizontal is used, whose flanges are arranged parallel to one another in planes perpendicular to the horizontal axis on which the roll is inclined, the flanges then playing the role of maintaining the previously unrolled fabric in rope form at the grooves. The folds formed by the folding arrangement according to the invention (6 of FIGS. 1, 2, 4 and 7; 9 of FIG. 5; 7–8 of FIG. 6, or equivalent devices) fall into the J-box 10 which is arranged immediately below the folding device, in which they are stored regularly over the whole width of the latter, without undergoing modification, since there is no circulation of the bath. The lower part of the J of the J-box, 10, opens into the storage compartment 4 in which it deposits the fabric in rope form in folds 11 that it has started to store. In the storage compartment 4, the fabric in rope form preserves during its whole storage phase, its folded shape 11 without disturbance, since there is no circulation of the path. In certain cases, the formation of folds in the J-box 10 is sufficiently regular, due to the fact of the particular conformation of said box, to be able to dispense with the arrangement of particular folding means, the cylindrical shape of drawing roll 7 then being selected.

The reascent of the fabric in the dyeing system, to undergo further treatment in the machine, is obtained not by means of the dye bath itself, as in the prior art, but essentially by mechanical return means for the fabric described in the foregoing.

Due to the fact that there is no interference between the bath and the folding process, one obtains a satisfactory continuity and rapidity of movement, of folding and of storage of the fabric in the machine according to the present invention, and consequently, extremely high circulating speeds of the fabric in the machine. The arrangement of the dyeing system at the reascent of the fabric in rope form enables also an increase optimally from the point of view of the requirements of dyeing, of the flow rate of the dyeing bath in the dyeing system so as to improve the quality of dyeing to an extent impossible to achieve with the prior art techniques, the improvement in the quality of dyeing on each passage of the fabric in rope form in the machine being of a nature to reduce the number of these passages and, consequently, reducing the cost price of the operations carried out in the machine and increasing the yield of the latter.

It should be mentioned also that the device for the circulation, folding and storage according to the invention, enables the capacity of the machine to be considerably increased, enabling simultaneously the realization of the wet treatment of several ropes of fabric in a single and same dyeing system and their storage in a single and same compartment. All the attempts made with machines in accordance with the prior art, to cause more than one rope to circulate at a time in one and the same dyeing system, and to effect storage in one and the same compartment, met with setbacks, in particular, when the ropes subject to the treatment were light fabrics or open-knit fabrics: in fact, the circulation of several ropes of light fabrics in the same dyeing system, and then in the same folding and storage systems, results in the formation of loops and knots which are not only troublesome and sometimes even prevent the circulation of the ropes, by causing the arrest of the machine, but spoil also the quality of the treatment applied, in particular in dyeing treatment. Now, the improvements introduced according to the present invention enable the production of perfect quality of folding and storage, not only in the case of a single rope of fabric, but especially when two ropes, and even three are circulating simultaneously through the same dyeing system and end up, after folding, in the same storage compartment. By multiplying the number of ropes treated, folded and stored simultaneously, a considerable increase in the capacity of the machine according to the invention is obtained and, consequently, of its yield, at the same time as a substantial reduction in the cost price of the treatments carried out in the machine.

It may be advantageous, for certain aqueous treatments, especially of dyeing, applied to certain categories of fabrics, to be able to provide two dyeing systems in the same machine. In such a case, shown diagrammatically in FIG. 8, the first dyeing system 1, is arranged in the upward path of the fabric 5, as in the embodiment described previously, whilst the second dyeing system 33 is arranged on the downward path of the fabric, preceding the J-box 10 for receiving and guiding the fabric to the storage compartment 4, that is to say that the dyeing systems 1 and 33 are arranged on both sides of the cylindrical drawing-drive roll 34 which has the purpose of pulling the fabric at its exit from the dyeing system 1, to bring it back to the storage compartment 4 through the J-box 10 and from the dyeing system 33.

Figure 6:
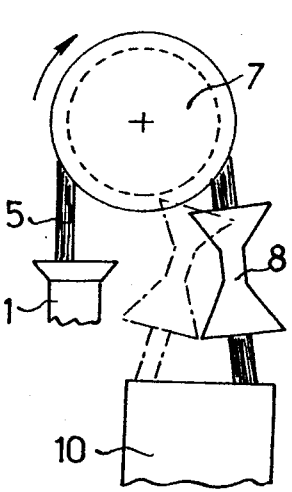
FIGS. 5 and 6 show diagrammatically two embodiments of the fabric return and folding means.

Such a machine, equipped with two dyeing systems respectively in the upward path and in the downward path of the fabric, may, if desired, be equipped with folding means, such as a ring or such as a double funnel shown in FIG. 6, which are then interposed between the output from the dyeing system 33 and the input of the J-box 10.

The arrangement of two dyeing systems, one in the upward path of the fabric and the other in the downward path of the fabric has the result of increasing the soaking effect of the fabric in the dye bath, in the course of the same operation, without presenting the drawbacks of known machines, due to the arrangment of a dyeing system in the upward path of the fabric.

In accordance with the invention, the second dyeing system, arranged in the downward path of the fabric is advantageously a removable system whose supply of dye bath is, preferably, done at a reduced flow rate, notably in the case of the treatment of several ropes simultaneously in the machine.

Indeed the two dyeing systems arranged in the upward path and in the descent path of the fabric increase the versatility of the machine since any combination of both dyeing systems is possible.

The machine according to the invention is provided with safety devices associated respectively with the J-box 10 and with the mechanical moving means for the fabric in the storage compartment 4. The safety device 13 mounted at the upper end of the J-box 10 has the purpose of detecting storage of the fabric at too high a level in the box 10, which would be the sign of an unsuitable speed of movement in the storage compartment 4, in the upward path. The safety device 13 may be constituted, for example, by a funnel which can pivot around a horizontal axis, in the case of detection of too high storage, to trigger a contactor which stops the drawing roll 6, 7,9 or the like and, if necessary, can reverse the direction of operation of the latter until the storage has reached, in the box 10, a lower level compatible with the necessities of operation of the machine, the funnel 13 then again taking up its resting position and releasing the triggering contactor.

Figure 4:
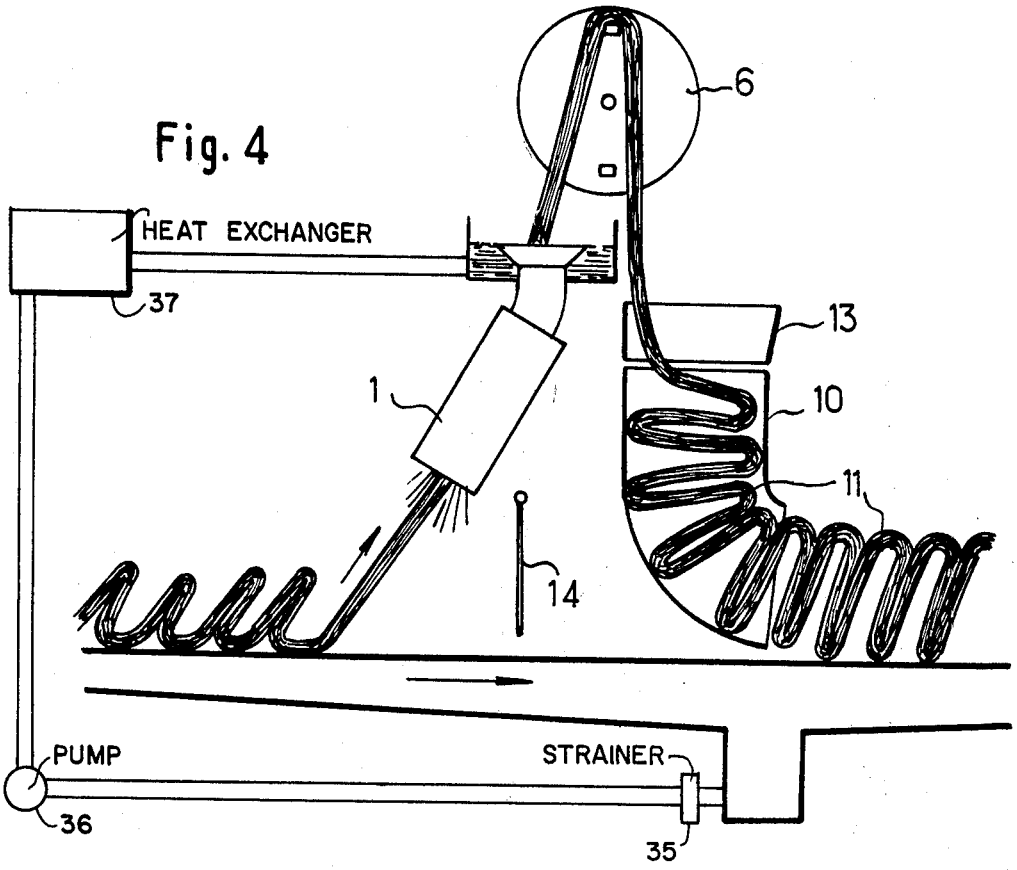
FIG. 4 is a partial section of the embodiment shown in FIGS. 1, 2 and 3, in operation, circulating, temperature-regulating and purifying devices being shown somewhat schematically.

Another safety device, denoted by the reference numeral 14, is associated with the storage compartment; it may be constituted, for example, by a pivoting wall 14 of which the pivoting is caused by too great an advance of the fabric in the compartment, in the vicinity of the upward path of the fabric, to an extent liable to risk causing interference with the fabric in folds 11 emerging from the J-box 10 (cf FIG. 7) or with the box 10 itself (cf FIG. 4). The pivoting of the wall 14 results in an adjustment of the speed of operation of the mechanical moving means for the fabric in the compartment 4, in particular an adjustment of the speed of the conveyor belt (FIG. 7) or an adjustment of the speed of rotation of the rotary cylinder or of the rotary crown which constitutes the storage compartment.

Figure 7:
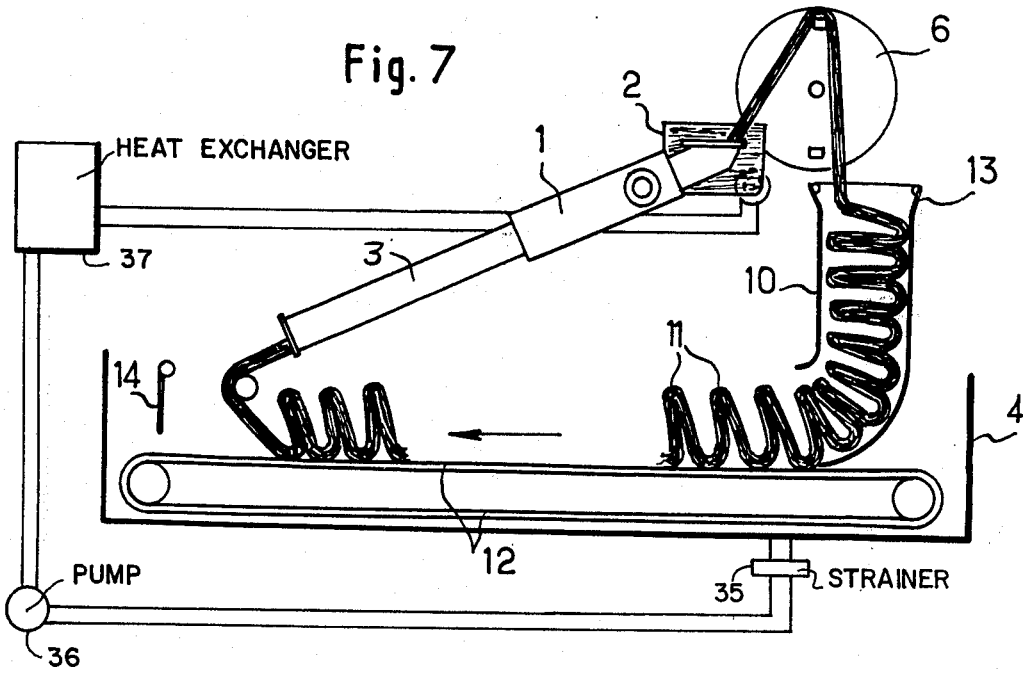
FIG. 7 shows a partial diagrammatic sectional view of one embodiment of a wet treatment machine, according to the invention, in operation, equipped with mechanical fabric moving means, constituted by a conveyor belt, circulating, temperature-regulating and purifying devices being shown somewhat schematically.
Figure 8:
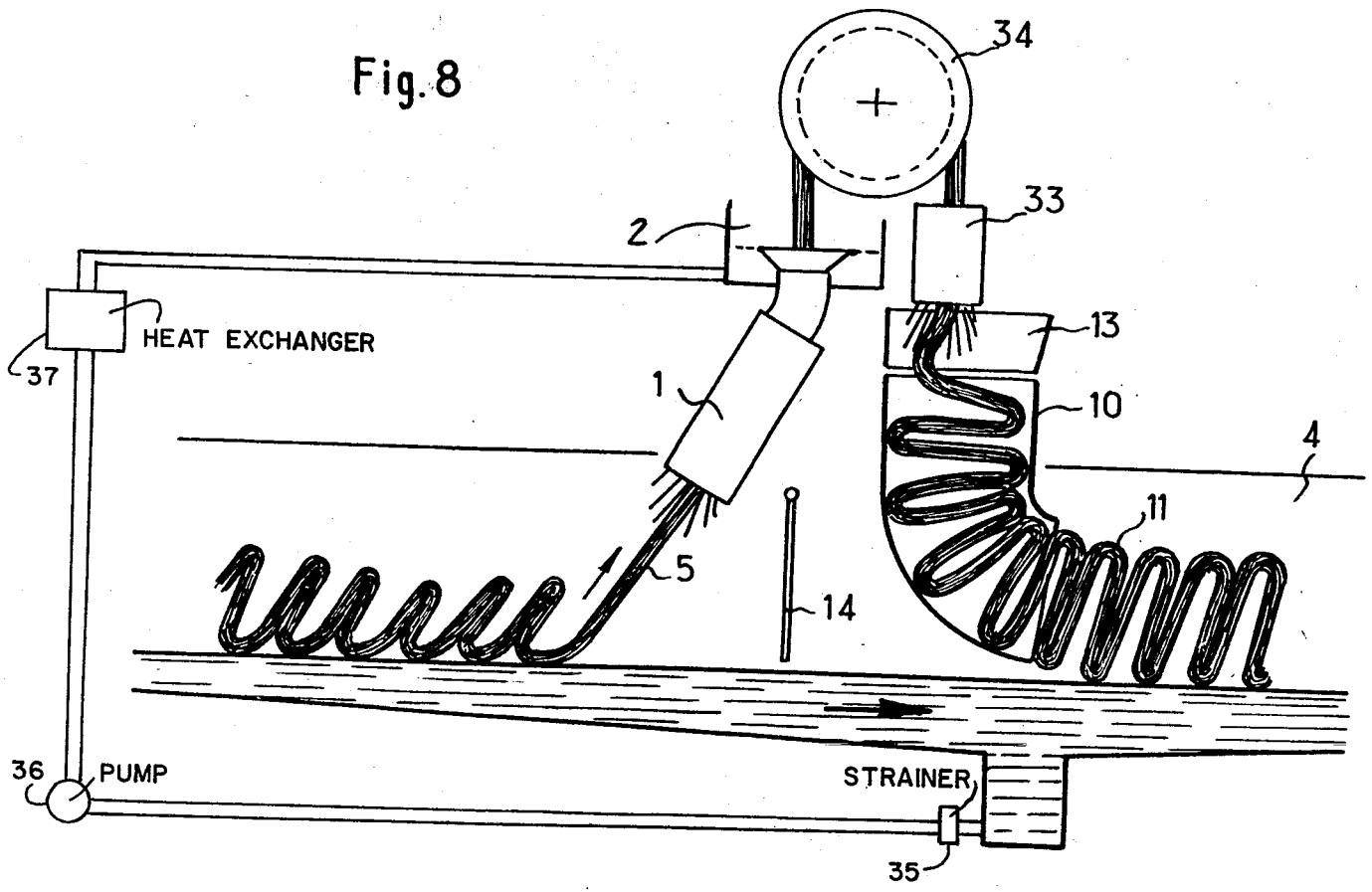
FIG. 8 shows a view similar to that of FIG. 4, of an embodiment of a machine according to the invention equipped with two dyeing systems mounted respectively in the ascent and in the descent paths of the fabric.

The wet treatment machines, as shown somewhat schematically in FIGS. 4, 7 and 8 may include means for circulating the dye bath, temperature-regulating means and means for purifying the bath material. The means for purifying can be, as illustrated, a strainer 35. The means for circulating as shown is a pump 36. The temperature-regulating means as shown can be a heat exchanger 37. The strainer 35, pump 36 and heat exchanger 37 are coupled in series via conduits between the dye bath and the overflow box 2.

Figure 11:
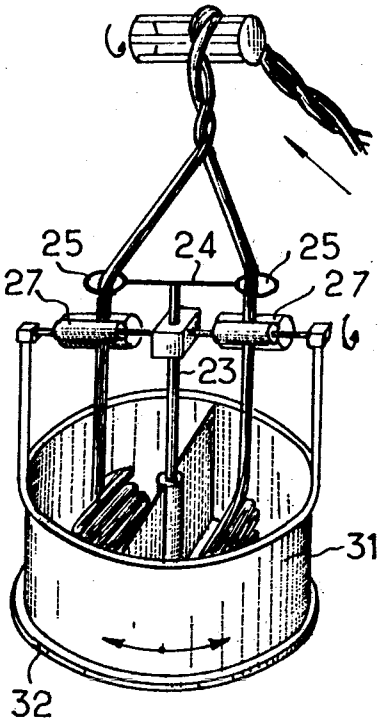
FIGS. 9, 10 and 11 show, in diagrammatic view in elevation, various embodiments of an unloading device for the ropes of fabric in accordance with the present invention.
Figure 10:
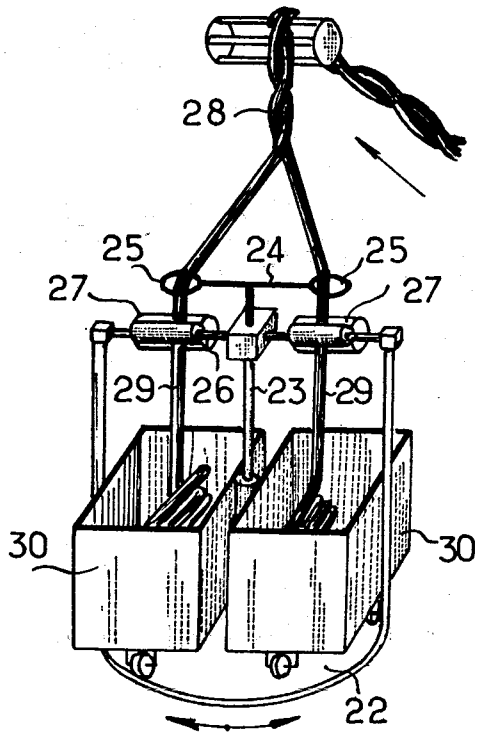
Figure 9:
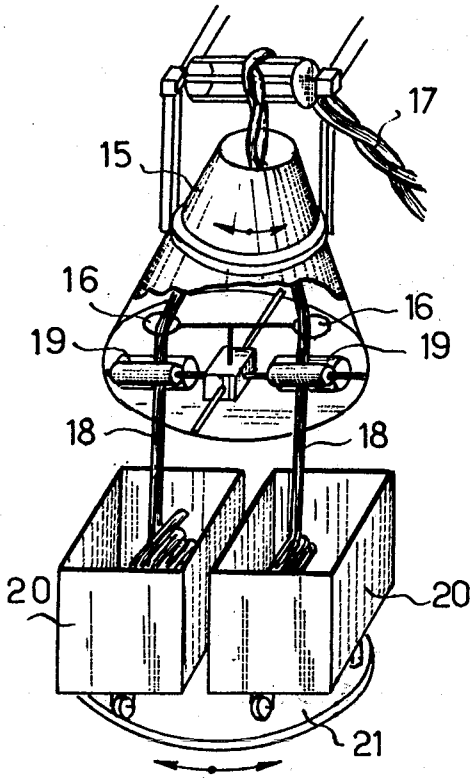

At their exit from the wet treatment machine, on emergence from the last passage through the dyeing, folding and storage systems, the ropes of fabrics are discharged from the machine by means of an unloading device which can be either fixed to the machine (cf FIG. 9), or independent of the latter and fixed to the ground (cf FIGS. 10 and 11). The fabric unloading device according to the invention is mounted at the output of the wet treatment machine. Although it is adapted to unload any number of ropes and notably a single rope or more than two ropes at once, it will be described below with reference to an example of application to the unloading of two ropes, such an example being of a nature to illustrate clearly the efficiency of said device. In fact, when two ropes (or more) have circulated simultaneously in a plurality of passages, through the dyeing system, then have been subjected to operations of folding and of storage, a certain number of twists can be produced and prevent easy separation of two ropes (or more) at the end of the treatment, on unloading. The unloading device according to the present invention has the purpose of undoing the twists simultaneously with the operations of unloading and includes, for this purpose, the following members: According to a first embodiment in which the device is mounted on the wet treatment machine, it includes a rotary funnel 15 to the inner wall of which are made fast two rings 16 providing for the passage of a rope 18 in each of them after untwisting the twisted ropes 17. A drive roll 19 fast to the funnel 15 is mounted below each of the rings 16. The contact of the twists of the rope with the funnel 15 determines the placing of the latter in rotation until the removal of the twists and the stopping of the drive rolls 19 during the same time. The two ropes are received either in two separate carriages 20 preferably mounted on a rotary plate 21 whose rotation is coordinated with that of the funnel 15, or in a single fixed carriage, with two concentric storage zones. Of course, the untwisting rotary funnel 15 only constitutes a non-limiting example, other equivalent solutions being substitutable, and notably two fixed and rotary rods.

According to another embodiment of the unloading means, in which the device is independent of the machine, said means comprise a rotary plate 22 which carries an axial rod 23 which supports at its upper end a support rod 24 for the two rings 25 and below the rod 24, a second rod 26, parallel to the first, on which are mounted two unloading drive rolls 27, the assembly 26–27 being if necessary replaceable by a single drive roll. The twists of the ropes 28 arriving at the level of the rings 25 will determine, through the axial rod 23, the rotation of the rotary plate 22 until the disappearance of the twists, and the unloading of the separate rope 29, into the carriages 30 (FIG. 10). According to a modification of this embodiment of the device, as shown diagrammatically in FIG. 11, the carriages 30 are replaced by a single carriage 31 mounted on a pivoting plate 32, to which is made fast the axial rod 23 which carries the rings 25 and the drive rolls 27.

The motorization of the one or more unloading drive rolls 19 or 27 is ensured either by rotary electrical power, or by a rack and pinion system.

It is clear from the foregoing description that, whatever the embodiments and applications adopted, improvements in or to wet treatment machines for cloth in rope form are obtained which have with respect to wet treatment machines for the same purpose known previously, considerable advantages of which certain have been mentioned in the foregoing and of which other advantages will emerge from the use of said wet treatment machines.

As will emerge from the foregoing, the invention is in no way limited to those of its embodiments and types of applications which have just been described more explicitly; it encompasses on the contrary all modifications which could be conceived by the technician skilled in the art, without departing from the scope or framework of the present invention.

We claim:

1. A processing machine notably for the dyeing of fabrics in rope form, equipped with a dyeing system and including means for circulating a dye bath, means for storage and means for folding, the machine comprising in combination:

at least one storage compartment having an exit;

at least one dyeing system arranged above and slightly beyond said exit of said at least one storage compartment, said at least one dyeing system having an exit and defining an upward path for the fabric;

mechanical means for returning the fabric to said at least one storage compartment via a downward return path after passage of the fabric into and out from said at least one dyeing system arranged in said upward path of the fabric, said mechanical means being mounted in the vicinity of said exit of said at least one dyeing system;

at least one receiving and guiding device for the fabric being returned to said at least one storage compartment, mounted in said return path of the fabric to said at least one storage compartment and positioned beyond said mechanical means; and wherein said at least one fabric storage compartment is provided with means for moving the fabric relative to said at least one compartment; and further comprising temperature-regulating means for said dye bath; and means for purifying said dye bath before its recycling in the machine; and means for unloading treated fabric from the machine comprising at least one ring and at least one unloading drive roll mounted downstream from said at least one ring and at least one moveable member to undo twist from the fabrics, and at least one receiving vat for the fabrics being unloaded.

2. A processing machine according to claim 1, including means for detecting twists in the fabric, and wherein said moveable member is constituted by a funnel fixed to the machine, to which is fixed said at least one ring designed for the passage of the fabric, in rope form, which funnel is moveable about an axis; and means responsive to said detection means for moving said said funnel when the presence of twists is detected and stopping said funnel in the absence of the twists.

3. A processing machine according to claim 1, wherein said at least one moveable member is constituted by two rods fixed to one another on the one hand and to said at least one ring on the other hand.

4. A processing machine according to claim 1, including means for detecting twists in the fabric, and wherein said at least one moveable member is constituted by a plate moveable about an axis and on which is mounted said at least one receiving vat for the said fabric being unloaded, which plate bears an axial rod which supports at its upper end, respectively said least one ring and said at least one unloading drive roll, rotation of said drive roll and said plate being determined by said means for detecting presence of the twists.

5. A processing machine according to claim 1, wherein said at least one receiving vat for the unloaded fabric, comprises a plurality of compartments.

6. A processing machine according to claim 1, wherein said at least one receiving vat comprises a plurality of contiguous independent carriages.

7. A processing machine according to claim 1, including means for rotating said at least one storage compartment about its vertical axis.

8. A processing machine according to claim 7, wherein said means for rotating and said mechanical means for moving said fabric relative to said at least one storage compartment are one and the same.

9. A processing machine according to claim 1, wherein said at least one ring comprises a plurality of rings.

10. A processing machine notably for the dyeing of fabrics in rope form, equipped with a dyeing system and including respective means for circulating a dye bath, means for storage and means for folding, the machine comprising in combination.

at least one storage compartment having an exit;

at least one dyeing system arranged above and slightly beyond said exit of said at least one storage compartment, said dyeing system having an exit and defining an upward path for the fabric;

mechanical means for returning the fabric to said at least one storage compartment via a downward return path after passage of the fabric into and out from said at least one dyeing system arranged in said upward path of the fabric, said mechanical means being mounted in the vicinity of said exit of said at least one dyeing system;

at least one receiving and guiding device for the fabric being returned to said at least one storage compartment mounted in said return path of the fabric to said at least one storage compartment and positioned beyond said mechanical means; and wherein said at least one fabric storage compartment is provided with means for moving the fabric relative to said at least one compartment; and further comprising temperature-regulating means for said dye bath; and means for purifying said dye bath before its recycling in the machine.

11. A processing machine according to claim 10, wherein said mechanical means comprises a conveyor belt.

12. A processing machine according to claim 10, wherein said means for circulating a dye bath is a pump.

13. A processing machine according to claim 10, wherein said temperature-regulating means is a heat exchanger.

14. A processing machine according to claim 10, wherein said means for purifying is a strainer.

15. A processing machine according to claim 10, wherein said at least one guiding device for the fabric is at least one J-box.

16. A processing machine according to claim 15, wherein each fabric receiving and guiding said J-box is equipped with a safety device which detects too high storage of the fabric in each respective said J-box and causes arrest of corresponding said mechanical means, reversal of their direction of operation until the removal of the excess fabric from the box concerned.

17. A processing machine according to claim 16, wherein each said safety device is constituted by a respective funnel pivoting around a respective horizontal axis, associated with an upper end of respective said boxes.

18. A processing machine according to claim 16, including means for reversing direction of operation of the corresponding said mechanical means for removal of excess fabric from the corresponding said J-box.

19. A processing machine according to claim 10, including at least one second dyeing system mounted in the return path of the fabric towards said at least one storage compartment between said mechanical means and said at least one fabric receiving and guiding device.

20. A processing machine according to claim 19, wherein said means for folding are inserted between said at least one second dyeing system mounted in the fabric return path to said at least one storage compartment and said at least one receiving and guiding device for the fabric.

21. A processing machine according to claim 19, wherein circulation of the fabric and flow of the dye both in said at least one dyeing system and said at least one second dyeing system takes place counter-current to one another.

22. A processing machine according to claim 10 wherein said means for folding form an integral part of said mechanical means for returning the fabric.

23. A processing machine according to claim 22, wherein the integrated said means for folding and said means for returning the fabric are constituted by a drive roll of non-cylindrical cross-section.

24. A processing machine according to claim 23, wherein said cross-section is oval or polygonal.

25. A processing machine according to claim 22, wherein the integrated said means for folding and said means for returning the fabric are constituted by a flat disc.

26. A processing machine according to claim 22, wherein the integrated said means for folding and said means for returning the fabric are constituted by a cylindrical roll having an axis inclined to the horizontal, fabric holding grooves being provided on said roll.

27. A processing machine according to claim 23, including a horizontal axle, and wherein the integrated said folding means and said means for returning the fabric are constituted by a cylindrical roll having an axis inclined to the horizontal, said roll being provided with flanges fixed to said horizontal axle on which said roll is inclined.

28. A processing machine according to claim 10, wherein said mechanical means are constituted by at least one cylindrical fabric-drawing drive roll.

29. A processing machine according to claim 10, wherein said means for folding are mounted downstream from at least one drawing drive roll.

30. A processing machine according to claim 11, wherein said means for folding are mounted upstream from at least one drawing roll between said exit from said at least one dyeing system and said at least one drawing roll.

31. A processing machine according to claim 28, including means distinct from said mechanical means operatively associated with said drive roll for folding the fabric.

32. A processing machine according to claim 10, wherein said means folding for are driven with a circular motion.

33. A processing machine according to claim 10, wherein said means for folding are driven with a to-and-fro motion.

34. A processing machine according to claim 10, wherein said means for folding are constituted by at least one ring.

35. A processing machine according to claim 10, wherein said means for folding are constituted by at least one double funnel.

36. A processing machine according to claim 10, including at least one safety device associated with said at least one storage compartment, which device comprises detecting means for any anomaly in advance of stock of the fabric into said at least one compartment and means for regulating speed of movement of the stock of the fabric in said at least one storage compartment.

37. A processing machine according to claim 36, wherein said safety device is constituted by a pivoting wall associated with a limit switch, itself possibly associated with a speed variator which regulates the speed of operation of the mechanical means for moving the fabric, which pivoting wall detects passage of stock of the fabric in folds and whose pivoting causes adjustment of the speed of operation of said mechanical means.

38. A processing machine according to claim 10, wherein circulation of the fabric and flow of the dye bath in said at least one dyeing system take place counter-current to one another.

39. A processing machine according to claim 10, wherein said means for purifying is a filter.

* * * * *